US005225070A

United States Patent [19]

Cornec et al.

[11] Patent Number: 5,225,070

[45] Date of Patent: Jul. 6, 1993

[54] OXYGENATED PITCH AND PROCESSING SAME

[75] Inventors: Ludovic P. Cornec; Charles C. Fain, both of Clemson, S.C.

[73] Assignee: Clemson University, Clemson, S.C.

[21] Appl. No.: 737,446

[22] Filed: Jul. 29, 1991

[51] Int. Cl.[5] ..... C10C 3/02

[52] U.S. Cl. ..... 208/44; 208/6; 208/22

[58] Field of Search ..... 208/6, 44, 22; 423/447.6, 447.7, 447.8

[56] References Cited

U.S. PATENT DOCUMENTS

| | | | |
|---|---|---|---|
| 4,005,183 | 1/1977 | Singer | 423/447.2 |
| 4,776,995 | 10/1988 | Nelson et al. | 208/45 |
| 4,975,263 | 12/1990 | Furuyama et al. | 423/447.7 |
| 4,986,943 | 1/1991 | Sheaffer et al. | 423/447.6 |

OTHER PUBLICATIONS

Cornec, Fain, and Edie, "Micro-Indentation Technique to Study Oxidation of Mesophase Pitch Fibers," Twentieth Biennial Conference on Carbon Extended Abstracts and Program, University of California, Santa Barbara (Jun. 23, 1991).

Hein et al, "Investigations of the Oxygen Reactivity of Tars and Pitches," Carbon, pp. 404–406, (1988).

Ma et al, "Oxidative Stabilization of Pitch-Based Carbon Fibers," pp. 128–129, Nineteenth Biennial Conference on Carbon Extended Abstracts and Program, Penn State University, (Jun. 25–30, 1989).

W. G. Stevens and R. J. Diefendorf, "Thermosetting of Mesophase Pitches I: Experimental", pp. 37–39, 4th International Conference on Carbon, Extended Abstracts, Baden-Baden, Germany, (1986).

W. G. Stevens and R. J. Diefendorf, "Thermosetting of Mesophase Pitches II: Theoretical", pp. 40–42, 4th International Conference on Carbon, Extended Abstracts, Baden-Baden, Germany (1986).

Mochida et al, "Control of Skin-Core Structure in Mesophase Pitch Based Carbon Fiber," Carbon, pp. 126–127 (1989).

Kazmer et al, "Oxidative Stabilization of Bulk Carbonaceous Materials," pp. 178–179, Twentieth Biennial Conference on Carbon Extended Abstracts and Program, University of California, Santa Barbara (Jun. 23, 1991).

Mochida et al, "The Introduction of a Skin-Core Structure in Mesophase Pitch Fibers through a Successive Stabilization by Oxidation and Solvent Extraction," Carbon vol. 29. No. 1, pp. 23–29 (1991).

Mochida et al, "The Introduction of a Skin-Core Structure in Mesophase Pitch Fibers by Oxidative Stabilization", Carbon vol. 28, No. 1, pp. 193–198 (1990).

Ling et al, "Mechanism of Air-oxidation Reaction for Coal Tar Pitch," pp. 294–295, International Carbon Conference, Extended Abstracts, Paris, France, 1990.

Wright et al, "Microstructural Analysis of Pitch Based Carbon Fibers", pp. 294–295, Nineteenth Biennial Conference on Carbon Extended Abstracts and Program, Penn State University, (Jun. 25–30, 1989).

(List continued on next page.)

*Primary Examiner*—Theodore Morris
*Assistant Examiner*—P. L. Hailey
*Attorney, Agent, or Firm*—Dority & Manning

[57] ABSTRACT

A method is provided which includes infusing oxygen into pitch material without stabilizing the oxygen-infused pitch material. In addition, the invention includes further processing steps (including heat stabilization in either an inert atmosphere or an oxygen-containing atmosphere, deformation, pyrolysis, and/or composite formation) performed after or in conjunction with the oxygenation process. Moreover, the invention includes the composition of matter (in any of a number of different physical forms such as powder, fiber, shaped article, composites) resulting from the practice of this oxygenation process, either alone or in conjunction with the further processing steps. The composition has a homogeneous distribution of oxygen and can be heat stabilized in an inert atmosphere.

20 Claims, 1 Drawing Sheet

OTHER PUBLICATIONS

Korai et al, "Mesophase Pitches Prepared from Methylnaphthalene by the Aid of HF/BF3," pp. 158–159, Twentieth Biennial Conference on Carbon Extended Abstracts and Program, University of California, Santa Barbara (Jun. 23, 1991).

White et al, "A Processing Window for Mesophase Injection," pp. 184–185, Twentieth Biennial Conference on Carbon Extended Abstracts and Program, University of California, Santa Barbara (Jun. 23, 1991).

J. L. White, "Pitch-Based Processing of Carbon-Carbon Composites," Carbon vol. 27, No. 5, pp. 697–707 (1989).

Kasuh et al, "Oxidation of Mesophase Pitch Fibers," pp. 626–628, 4th International Conference on Carbon, Extended Abstracts, Baden-Baden, Germany (1986).

Kasuh et al, "Oxidation of Mesophase Pitch Fibers (II)," pp. 292–294, Proceedings of an International Conference on Carbon, Extended Abstracts, University of Newcastle upon Tyne, U.K., edited by B. McEnaney and T. J. Mays, (1988).

OXYGENATED PITCH AND PROCESSING SAME

BACKGROUND OF THE INVENTION

The present invention relates to pitch materials and more particularly to problems associated with stabilization of pitch material, either before or after the pitch material has been used to form fibers and other articles of manufacture.

Pitch is a graphitizable substance, i.e., a substance which fuses or becomes plastically deformed during heat treatment. Pitch is thermoplastic and thus can be melted by heating, followed by being allowed to cool to solidify, and then remelted and resolidified time and again. Pitch is a collection of hydrocarbons ranging from low molecular weight paraffins to high molecular weight large aromatics. There are byproduct pitches, such as coal tar or petroleum pitch, which are byproducts of oil cracking processes. There also are synthetic pitches. Two examples of synthetic pitches include specially prepared polyvinylchloride and specially prepared methylnapthalene. Mesophase pitch can be produced by such different techniques as heat treatment of coal tar or petroleum pitches or by solvent extraction of these pitches, or chemically prepared from methylnapthalene with the aid of $HF/BF_3$. The coal tar and petroleum pitches are isotropic, while the mesophase pitches are anisotropic. Pyrolysis of pitch material, i.e., heating the pitch at temperatures above about 1,000° C. in an inert atmosphere, converts the pitch to carbon or graphite material, depending on the parameters of the high temperature treatment. Generally, when talking about fibers, one produces carbon fibers at pyrolysis temperatures relative to about 1,700° C. Above 1,700° C., and on up to pyrolysis temperatures of 3,000° C., the fibers are referred to as graphite fibers.

At room temperature in ambient air, pitch material exists as solid matter. It typically is supplied commercially in powdered or granular form or pellets, which are sized smaller than one cubic centimeter in volume. A common use of the pitch involves heating the pellets to about 350° C., where they melt, and then extruding the melted pitch through tiny diameter holes to form elongated fibers having transverse cross-sectional diameters on the order of 10 to 100 microns. Desirably, these pitch fibers can be pyrolyzed (heat treated in an inert atmosphere at temperatures above 1,000° C.) in order to form carbon and/or graphite fibers which have numerous industrial applications. A typical carbonization temperature is 1,500° C., and a typical graphitization temperature is 2,400° C. However, subjecting the pitch fibers immediately to temperatures above the 350° C. melting point of the pitch, would melt the fibers back into an amorphous, free-flowing mass of pitch.

Accordingly, before pitch material can be pyrolyzed and transformed thereby into carbon and/or graphite material, the pitch must be heat stabilized in a manner that permits the pitch to maintain its shape and molecular orientation while undergoing pyrolysis. The thermoplastic pitch must be thermoset and rendered infusible so that it no longer melts when heated in the absence of oxygen. In other words, the heat stabilization process permits the pitch to retain the pitch's physical integrity and molecular integrity during the pyrolysis process.

The heat stabilization process has many names, such as stabilization, thermosetting, curing, oxidation, oxidative stabilization, etc. Whatever the name, the process used to stabilize the pitch involves gradually heating the pitch in an oxygen-containing atmosphere from room temperatures to temperatures just below the melting point of the pitch, typically about 350° C. This can be accomplished by contacting the pitch material with heated flowing air. For example, a typical stabilization technique for mesophase pitch carbon fibers with diameters in the range of 10 to 40 microns, would begin heating at room temperature (25° C.) in an air atmosphere to a temperature of 225° C. at a constant rate for thirty minutes (6.67° C./min.), followed by maintaining the 225° C. temperature for an additional thirty minutes, and followed by heating from 225° C. to 265 C. at a constant rate over a period of 180 minutes (0.22° C./min.).

Stabilization of isotropic pitch or mesophase pitch involves numerous chemical reactions coupled with mass transport of reactant, primarily oxygen, from the ambient air (or an artificially created oxygen-rich atmospheric environment) to reactive sites inside the pitch article. The oxygen that is absorbed, cross-links aromatic structures which preserve the axial preferred orientation of the article during pyrolysis. To avoid reorientation and rearrangement of the mesophase molecules, the stabilization heat treatment must be performed below the glass transition temperature. Authors have also reported that stabilization heat treatment at low temperatures favors the formation of carbonyls such as quinones and carboxylic acids, which produces homogeneous stabilization. Higher temperature stabilization heat treatments have resulted in ester cross links, and CO, and $CO_2$ products after C/C bond fissure.

Infrared absorption (IR), thermogravimetry analysis (TGA), nuclear magnetic resonance (NMR), differential scanning calorimetry (DSC), and various elemental analysis are techniques extensively used to study the oxidation mechanisms. A useful characterization of the stabilization of the pitch article can be related to the profile that is obtained by noting the localized concentration of oxygen at different depths measured from the surface of the article. For example, because of their size, stabilization of large diameter pitch-based fibers is rarely homogeneous in the cross section of the fibers. To homogeneously stabilize a fiber, oxygen needs to diffuse into the whole fiber. For very short oxidation times or for large diameter fibers, oxygen does not reach the center of the fiber, and such stabilization tends to introduce a skin/core microstructure during carbonization. The skin thickness is believed to vary as the square root of time, indicating a diffusion controlled process of stabilization. The outer part (nearest the outer surface of the fiber) often appears to be over oxidized, while the core (at the center of the fiber) is insufficiently stabilized and allows porosity formation and higher mobility of the molecular structure during pyrolysis. A fiber with such a profile of stabilization cannot be expected to have good mechanical properties. After carbonization, the skin is generally characterized by very fine sheets of crystallites, and coarse sheets of about 2.0 to 3.0 microns in width prevail in the core.

The chemical bonds created when the oxygen reacts with pitch, tend to increase the melting point of the pitch until the pitch has been rendered infusible. Increased penetration of oxygen into the interior of the pitch article promotes more stabilization. As the stabilization process progresses, the pitch material undergoes a decrease in solubility and an increase in mechanical properties such as tensile modulus.

The optimal stabilization process particulars, i.e., heating rates and durations, isothermal heating temperatures and durations, and maximum temperatures, of the stabilization process used for one application may vary somewhat from the optimal stabilization process particulars for a different application. The variance in process particulars may manifest itself in the rate of temperature increase and the duration of time spent during one or more temperature increases or at one or more discrete temperature levels. For example, the temperature of stabilization depends on the reactivity of the pitch material to be stabilized, which is a function of the material itself. Typical stabilization temperatures range from 220° C. to 350° C. Moreover, the required duration of the stabilization step depends on temperature, heating rate, the reactivity of the pitch, and the maximum depth which must be penetrated by the oxygen. As a general rule the thicker the article, the longer it takes to stabilize at any given temperature. Thus, larger diameter pitch fibers would be expected to require longer heating times. Heat treatments can take from a few minutes to two hours for small diameter fibers, and more than six hours can be expected for large diameter fibers. Indeed, most pitch articles with dimensions more than 100 microns thick cannot be economically stabilized because of the long time that the pitch must be maintained at temperatures on the order of 300° C. and the inadequate stabilization of the innermost regions of the article.

OBJECTS AND SUMMARY OF THE INVENTION

It is a principal object of the present invention to provide a method of infusing oxygen into pitch without stabilizing same so that the resulting oxygenated pitch can be formed into any desirable shape prior to being stabilized in such shape.

It is another principal object of the present invention to provide a pitch material that is infused with oxygen without being stabilized so that such oxygenated pitch can be formed into any desirable shape prior to being stabilized in such shape.

It is a further principal object of the present invention to provide a method of infusing oxygen into pitch without stabilizing same so that stabilization of the resulting oxygenated pitch after being formed into any desirably shaped article prior to being stabilized in such shape, can be accomplished more economically regardless of the heretofore unheard of large thicknesses of the shaped article.

A still further principal object of the present invention is to provide a pitch material that is infused with oxygen without being stabilized so that such oxygenated pitch can be formed into any desirable shape prior to being stabilized in such shape and pyrolyzed in such shape in a carbon or graphite form.

It is another principal object of the present invention to provide a method of infusing oxygen into pitch without stabilizing same so that stabilization of the resulting oxygenated pitch after being formed into any desirably shaped article prior to being stabilized in such shape, can be accomplished with more precise control over the stabilization process and its effect on the microstructure of the article than heretofore has been possible.

It is a still further principal object of the present invention to provide a method of infusing oxygen into pitch without stabilizing same so that stabilization of the resulting oxygenated pitch after being formed into any desirably shaped article prior to being stabilized in such shape, can be accomplished in a manner that stabilizes the article more homogeneously than heretofore has been possible.

It is yet a further principal object of the present invention to provide a method of infusing oxygen into pitch without stabilizing same so that stabilization of the resulting oxygenated pitch after being formed into any desirably shaped article prior to being stabilized in such shape, can be accomplished in a manner that optimizes the stabilization profile of the article.

It is yet another principal object of the present invention to provide a method of infusing oxygen into pitch based fibers without stabilizing same so that the resulting oxygenated pitch fibers can thereafter be stabilized in such shape in bulk quantities.

It is yet another principal object of the present invention to provide a method of infusing oxygen into pitch without stabilizing such oxygenated pitch so that the resulting oxygenated pitch can thereafter be simultaneously formed in a desired configuration and stabilized in such configuration at temperatures above a critical temperature (described below) while in either an oxygen-containing atmosphere or an inert atmosphere.

It is a yet further principal object of the present invention to use the property of the oxygenated pitch that enables such oxygenated pitch to be simultaneously formed in a desired configuration and stabilized in such configuration at temperatures above a critical temperature (described below) while in either an oxygen-containing atmosphere or an inert atmosphere, to form a matrix composite or an in situ composite.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a method is provided which includes infusing oxygen into pitch material without stabilizing the oxygen-infused pitch material. In addition, the invention includes further processing steps performed in conjunction with the oxygenation process. Moreover, the invention includes the composition of matter (in any of a number of different physical forms such as powder, fiber, shaped article, composites) resulting from the practice of this oxygenation process, either alone or in conjunction with the further processing steps.

Briefly, according to the present invention, pitch material is heated in an oxygen-containing atmosphere at one or more temperatures above room temperature (20° to 25° C.), being careful not to exceed a predetermined critical temperature, $T_c$, which is the oxygen stabilization reaction temperature (explained below) of the pitch material. The heating is continued for a length of time that depends upon the amount of oxygen to be concentrated in the pitch material. In addition, the particulars of the heat treatment, such as the values of the heating temperatures (below the critical temperature), the duration of time of heating at one or more temperatures, and the rate of heating between one isotherm and another, depend upon such factors as the amount of oxygen that is desired to be concentrated into the pitch material, the physical characteristics of the pitch material, the reactivity of the pitch material, the pressure in the heating chamber, the concentration of oxygen in the atmosphere of the heating chamber, and the intended end use of the pitch material.

The oxygenated pitch material of the present invention can be permitted to return to room temperature, and the heating process can be repeated again and again any number of times, so long as the critical temperature is not exceeded. Each time the heating process (never exceeding the critical temperature) is repeated, the amount of oxygen concentrated in the pitch material increases.

The oxygenated pitch produced according to the present invention, generally has a homogeneous concentration of oxygen throughout the material, and the concentration of oxygen is more uniformly distributed as a function of position than is possible to achieve by conventional stabilization techniques.

The process can further include heating the resulting oxygenated pitch material in an inert atmosphere for a sufficient length of time and at one or more temperatures sufficient to pyrolyze the oxygenated pitch material. Because of the concentrated oxygen within the oxygenated pitch material, there is no need for a conventional stabilization heat treatment step prior to performing the pyrolysis to convert the pitch material into carbon and/or graphite.

Pitch material in any form can be subjected to the process of the present invention to yield oxygenated pitch material. For example, the form of the pitch material could be powder, granular, sheet, fiber, or shaped article of manufacture.

As noted above, an important characteristic of the oxygenated pitch of the present invention is that it can be stabilized in an inert atmosphere by heating it above the specific critical temperature of the pitch material. Another important characteristic of the process and oxygenated pitch of the present invention is that, if the oxygenated pitch is rapidly heated above its melting point, preferably in an inert atmosphere, the oxygenated pitch is capable of undergoing a certain amount of deformation and shaping before heat stabilization of the oxygenated pitch occurs. The ability to deform and shape the oxygenated pitch material before it completes heat stabilization, enables one to rapidly apply heat and pressure to the oxygenated pitch and form carbon matrix composites (using pitch powder for example) and in situ carbon/carbon composites (using pitch fibers for example).

The accompanying drawings, which are incorporated in and constitute a part of this specification, help to illustrate one or more embodiments of the invention and, together with the description, serve to explain the principles of the invention.

DETAILED DESCRIPTION OF THE PREFERRED EMBODIMENTS

Reference now will be made in detail to the present preferred embodiments of the present invention, examples of which are explained below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used in another embodiment to yield a still further embodiment. Thus, it is intended that the present invention cover the modifications and variations of this invention provided they come within the scope of the appended claims and their equivalents.

In accordance with the present invention, a mass of pitch material is subjected to heating in an oxygen-containing atmosphere for a predetermined period of time at one or more temperatures not to exceed a critical tèmperature $T_c$.

The pitch material can be natural pitch byproducts of the petroleum cracking process or synthetic pitch and can be isotropic pitch or anisotropic pitch (such as mesophase). Examples of suitable pitch are: HS pitch (anisotropic, heat soak natural pitch prepared as in U.S. Pat. No. 4,005,183 to Singer, which is hereby incorporated herein by reference); Ashland 240 pitch (isotropic, available from the Ashland Chemical Company); A80 AEROCARB pitch (isotropic, available from Ashland Chemical Company); Mit.AR pitch (chemically prepared, mesophase, anisotropic, available from Mitsubishi Chemical Company).

The predetermined time during which the pitch material is subjected to the heat treatment below $T_c$ is determined depending upon the intended end use of the oxygenated pitch material that is the product of the process of the present invention. For example, if the pitch material is to be formed into a carbon matrix with carbon fibers (carbon/carbon types of composition) or ceramic fibers, the heat treatment should last long enough to add about 3 to 6 percent by weight oxygen content to the pitch material. This amount of oxygen would suffice to stabilize the oxygenated pitch when heat was later added to stabilize the matrix and form a carbon/carbon composite.

Figure 2:
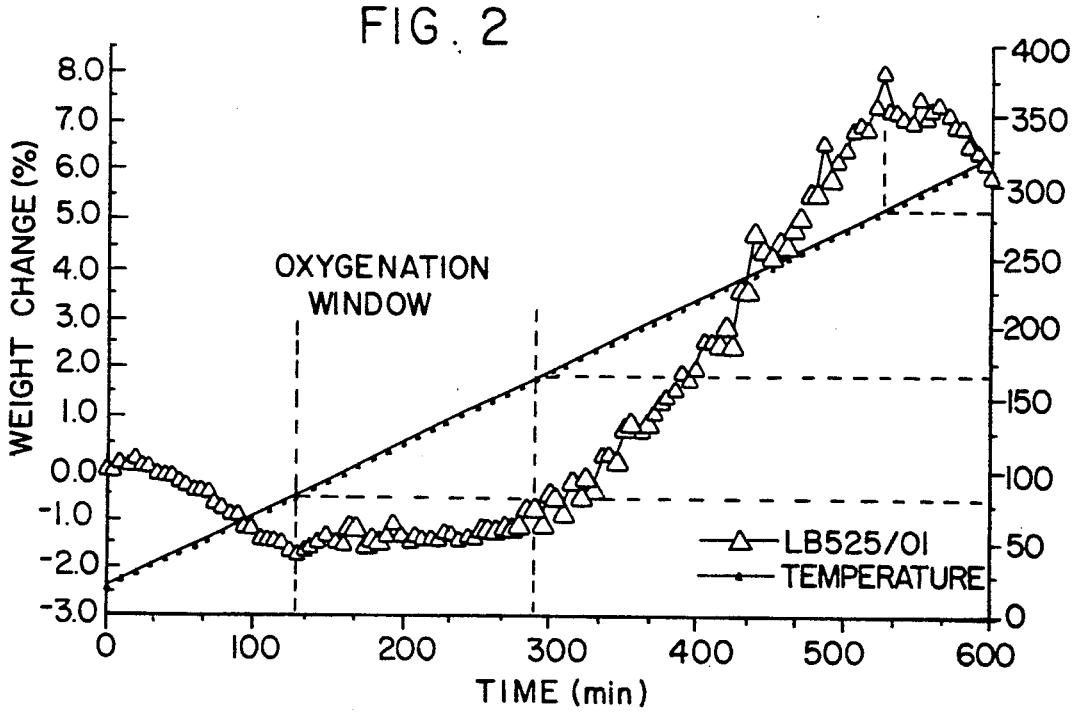
FIG. 2 illustrates a thermogravimetric analysis showing the weight change as a function of time during a slow constant rate heating of mesophase pitch-based fibers and identifying the oxygenation window that exists before the period of a very rapid weight gain that is characteristic of the oxygen forming bonds once the critical oxygen stabilization temperature has been attained.

In further accordance with the present invention, the value of the critical temperature, $T_c$, for the oxygenating heat treatment to the present invention, is dependent upon the type of pitch material being subjected to the oxygenating process of the present invention. The critical temperature $T_c$ is the temperature at which the oxidation reaction begins to occur in the pitch material. As shown in FIG. 2 for example, the temperature $T_c$ is characterized by the initiation of a relatively very high rate of weight gain per unit of time. This relatively high rate of weight gain is believed to be the result of the oxygen reacting with the pitch material and forming bonds with the pitch material at a rapid rate.

The $T_c$ for any given material can be determined by a thermal analysis which uses a differential scanning calorimeter (DSC) such as the 910 Differential Scanning Calorimeter System available from DuPont Company. One heat soak (HS) pitch (like the Singer pitch) has a I'c of about 177.5° C. The A80 AEROCARB pitch has a Tc of about 170. C The MIT.AR mesophase pitch has a Tc of about 160° C.

Figure 1:
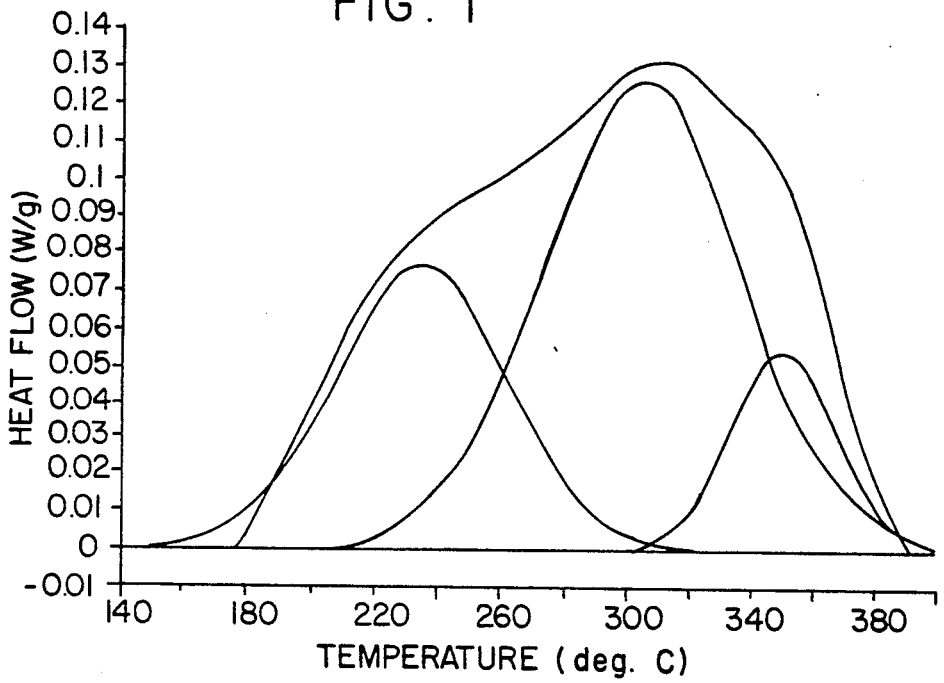
FIG. 1 illustrates a differential scanning calorimetry graph used to determine the critical temperature, $T_c$, for an HS pitch prepared as in the Singer patent (U.S. Pat. No. 4,005,183)

The following explanation is provided to convey how to go about determining $T_c$ for a given material. Place a sample of the pitch in question in a differential scanning calorimeter. Starting at room temperature (25° C.), slowly increase the temperature of the sample while performing a differential scanning calorimetry run in air. For example, the temperature should be increased at a rate of 1° C. per minute until attaining an elevated temperature of about 600° C. As one proceeds with this slow heating of the pitch material, the value of $T_c$ is the temperature at which the first exothermic reaction begins. An example of a differential scanning calorimetry graph used to determine the value of $T_c$ for the HS pitch prepared like the Singer pitch, is shown in FIG. 1. Notice that the first exothermic reaction (positive heat flow) begins at a temperature of about 177.5° C. This identifies $T_c$ for the HS pitch prepared like the Singer pitch as a temperature of about 177.5° C.

The pitch material that is subjected to the process of the present invention can exist in any one of a number of different forms. The pitch material can exist in a powdered form. The pitch material can exist in a pellet form. The pitch material can exist as a manufactured form. As examples of the latter, the pitch material could have been meltspun into elongated fibers and wound on a spool or porous spool. The pitch could be cast in the presence of an inert atmosphere to form a shaped article or sheet or film of some specific size. Any and all of these forms could then be oxygenated by the oxygenating process of the present invention.

The temperature as a function of the time of the oxygenating process of the present invention can vary so long as the temperature never exceeds $T_c$. Thus, one or more temperatures below $T_c$ can be used to perform the oxygenating process of the present invention. Preferably, the maximum temperature attained by the pitch during the oxygenating process of the present invention should be kept about 5° C. to 10° C. below $T_c$. For example, a $T_c$ of 177.5° C. for a mesophase pitch such as the HS pitch prepared as disclosed in the Singer patent, is desirably heated to a temperature that does not exceed 165° C. and preferably stays within the 145° C. to 165° C. range for almost the entire duration of the heating process.

The temperature, pressure, and surface area of the pitch material all can be adjusted in order to optimize the rate of oxygenation for the application of the oxygenated pitch material that is being produced. It is thought that a particular rate of adding oxygen to the pitch material would be more suited to one application of the oxygenated pitch than to another application of the oxygenated pitch. Thus, the rate of oxygenation can be controlled by controlling the temperature and pressure at which the pitch material is heated and also by taking into consideration the surface area of the pitch material that is being heated and the relative thickness of different portions of the mass of pitch material that is being heated to oxygenate same according to the process of the present invention.

In accordance with the oxygenated pitch that exists after the pitch is subjected to the process of the present invention, the oxygenated pitch can a high concentration of oxygen throughout the oxygenated pitch material. Moreover, the concentration of oxygen throughout the oxygenated pitch material of the present invention is generally much more homogeneous than is present in conventional pitch which has been stabilized by conventional techniques. The concentration of oxygen throughout the oxygenated pitch material of the present invention is generally more uniformly distributed as a function of position, than is possible to achieve by conventional stabilization techniques. The oxygenated pitch of the present invention is capable of being stabilized by heat treatment above the specific critical temperature $T_c$ of the material in an inert (no oxygen) atmosphere. Moreover, the oxygenated pitch of the present invention can be stabilized by heat treatment above the specific critical temperature $T_c$ of the material in an oxygen-containing atmosphere. Furthermore, the oxygenated pitch of the present invention can be stabilized much faster than an unmodified pitch that is not subjected to the process of the present invention.

Another property of the oxygenated pitch of the present invention is its ability to be oxygenated any number of times so long as the oxygenated pitch has never been heated above its $T_c$ and as long as oxygen saturation has not been reached. Thus, each time the oxygenated pitch of the present invention is heated, the oxygen concentration of the oxygenated pitch increases further.

One problem with the oxygen that must be present in order to stabilize pitch material, pertains to the pyrolysis process in which the stabilized pitch is to be converted into carbon and/or graphite by the addition of heat at high temperatures while confined within an inert atmosphere. (The inert atmosphere prevents burning of the pitch at the high temperatures).

According to several authors, about 6% by weight oxygen is necessary to stabilize conventional pitch when using conventional heat stabilization techniques. Using the oxygenating process of the present invention to produce the oxygenated pitch of the present invention, a 6% by weight oxygen content can be obtained. However, the oxygenated pitch of the present invention has a better (more homogeneously uniform) distribution of oxygen than occurs using conventional heat stabilization techniques to stabilize conventional pitch. Thus, the oxygenated pitch of the present invention likely can be heat stabilized at less than 6% by weight oxygen content. Accordingly, in the oxygenated pitch of the present invention, less oxygen products would have to be removed during the high temperature heat treatment of the pyrolysis process. Therefore, the present invention reduces the problems that are caused by the defects produced in the pyrolyzed carbon/graphite article during removal of the gaseous products produced during pyrolysis. It should also decrease the time to pyrolize a carbon article. It should decrease the probability of inducing defects. It should provide for better shape control.

Importantly, if the oxygenated pitch is rapidly heated above its melting point, preferably in an inert atmosphere, the oxygenated pitch is not immediately stabilized throughout. This is because the entire mass of oxygenated pitch does not immediately attain temperatures above $T_c$ and because a certain amount of time is required to complete the reactions responsible for forming the bonds that characterize the stabilized pitch. Thus, under these conditions, it is possible to subject the oxygenated pitch material of the present invention to a certain amount of deformation and shaping before the stabilization occurs. This shaping and/or deformation must occur during the time just prior to the time when complete heat stabilization of the oxygenated pitch has occurred.

Heretofore, only unmodified pitch (without oxygen content) could be deformed. Now, the oxygenated pitch of the present invention can be made to undergo changes in shape, notwithstanding that such oxygenated pitch contains oxygen. Using oxygenated pitch will allow excellent deformation and flow above its melting temperature $T_M$. Therefore, it would be possible to "pultrude" (elongate the pitch by pulling it in a particular direction) shaped carbon/carbon composites and continuously stabilize and pyrolyze such composites. It should be possible to rapidly heat the oxygenated pitch of the present invention and extrude such pitch through large dies (with cross section measured in feet) or through spinnerettes to produce fibers of various lengths and about 50 to 100 microns in diameter.

The ability to deform the oxygenated pitch of the present invention provides the first opportunity to use shear stress to induce mesophase alignment in composites, much like you can induce mesophase alignment in meltspun fibers, yet almost instantaneously maintain that alignment in the matrix of composites and thereby increase the tensile and thermal conductivity properties of the matrix.

Moreover, oxygenated powders formed into larger thick carbon articles (with thicknesses measured in inches and likely feet) could be stabilized through the use of this invention simply because the oxygen does not have to diffuse through the thickness of the oxygenated pitch article in order to arrive at the interior portions of the article. In the oxygenated pitch article of the present invention, the oxygen is already there in the interior of the article and waiting to react and form chemical bonds when heated above $T_c$. For the same reasons and in further accordance with the present invention, thick carbon/carbon composites utilizing oxygenated pitch could be stabilized faster and better and in thicknesses heretofore impractical if not impossible.

Processes are available to spread tows of fibers and coat each fiber with a film or powder and then place the bundles of coated fibers into a mold where heat and pressure is applied to the bundles of coated fibers to form composites. In accordance with the present invention, oxygenated pitch powders could be used as the coating for the tows of carbon fibers, thereby assuring heat stabilization of the entire carbon/carbon composite. Similarly, in the case of film coating, one would simply melt the unmodified pitch (without oxygen) onto the fibers in an inert atmosphere prior to oxygenating the pitch film coating and/or the fibers (depending upon whether the fibers are pitch, oxygenated or unmodified, and thus can be oxygenated according to the present invention).

Moreover, this process of the present invention could even allow one to make a carbon fiber composite without an added matrix. Here you would begin simply oxygenating the pitch fibers according to the present invention. Then you apply heat at one or more temperatures above $I_c$ to the oxygenated fibers of the present invention. This can be done in an atmosphere in which oxygen is present or absent, as desired. Preferably, one would choose an inert atmosphere, because this would provide the greater degree of control and the larger amount of time for conducting the deformation step of the process. Simultaneously with the application of heat at one or more temperatures above $T_c$ to the oxygenated fibers, one applies pressure to deform the fibers and bond the fibers to one another, rather than to a separate material acting as a matrix or binder. Thus is formed an in situ carbon/carbon composite in accordance with the present invention.

The oxygenated pitch of the present invention can exist in the form of pitch powders, granules, pellets, large articles of manufacture, as part of the carbon material in a carbon/carbon composite or in a carbon/non-carbon composite.

Among the additional anticipated uses or applications for the oxygenated pitch of the present invention is as a filler to produce carbon electrodes. It also could be used as a special refractory material in ceramics. Another use might be for the fabrication of carbon brakes that were heretofore economically prohibitive for widespread use. Another anticipated use of the oxygenated pitch would be in special composite materials.

As noted above, a particularly unique feature of the oxygenated pitch of the present invention is its ability to be heat stabilized in an inert atmosphere (no oxygen present in the atmosphere). This characteristic of the oxygenated pitch of the present invention, permits the elimination of the typical stabilization heat treatment that constitutes a preliminary step in the formation of carbon or graphite articles. Instead, a carbon or graphite article that is produced from oxygenated pitch according to the present invention, can be heat treated at carbonization or graphitizing temperatures without first undergoing a separate conventional heat stabilization treatment.

Additionally, it is thought that the reactions between oxygen and the pitch material that occur during stabilization temperatures (temperatures higher than $T_c$), impede the further diffusion of oxygen into the pitch material. This obstruction is believed to be caused by the chemical bonds that form during the stabilization reactions with oxygen. These bonds are believed to impede further diffusion of oxygen into the innermost depths of pitch material. This obstruction due to the formation of the oxygen bonds, does not occur during the diffusion process that occurs with the heat treatment kept below $T_c$ as in the present invention. Accordingly, while large objects that are made with conventional pitch (unmodified by oxygenation according to the present invention) only can be stabilized to the depth of penetration of oxygen (typically 50 to 70 microns) during conventional stabilization techniques, objects of any size (depths from their exterior surfaces) made with, or processed to contain, oxygenated pitch of the present invention, can be entirely stabilized throughout their innermost portions The concentration of oxygen in the oxygenated pitch of the present invention eliminates the need for any additional diffusion of oxygen into the material prior to stabilization. Thus, a conventional unmodified pitch article could be subjected to the oxygenating process of the present invention to convert the unmodified pitch in the article, to oxygenated pitch. Then the article formed of oxygenated pitch of the present invention could be heated above $T_c$ to stabilize it uniformly throughout the article. The heating could occur either in the presence or absence of oxygen.

EXAMPLE A

A sample of HS mesophase pitch (like that of the Singer patent) in powder form and weighing 1.5339 grams was subjected to an oxygenating heat treatment according to the process of the present invention in the following manner.

The pitch powder sample was spread on an inert ceramic cloth, and the cloth and pitch were placed on a stainless steel holder. Each of the holder alone, the cloth alone, and the combined holder plus cloth plus powder, were weighed. The weight of the combined holder, cloth and powder was 5.9749 grams. The combined holder, cloth and powder was placed in a hot air blowing furnace. Beginning at a room temperature of 25° C., the temperature inside the furnace was increased at a rate of approximately 10° C. per minute to a maximum temperature of 170° C. Upon attaining 170° C., the temperature inside the furnace was kept at 170° C. for 5,221 minutes before the sample was removed from furnace. The weight of the holder, cloth and pitch powder after removal from the furnace was 6.0105 grams. Based on the differences in the measured weights before and after the heat treatment process according to the present invention, the weight of the powder was determined to have increased by 2.321% of its initial weight.

The weight gain of the powder was believed to indicate an increase in the amount of oxygen adsorbed (or diffused) into the pitch powder. Accordingly, an elemental analysis was performed by Galbraith Laboratories, Inc. (Knoxville, Tenn.) on this same oxygenated powder. The results of the elemental analysis indicated the presence of 3.6% by weight oxygen in the oxygenated pitch powder of the present invention.

The oxygenated pitch powder of the present invention was subjected to a flame test, which indicated that the powder was still fusible. When the same oxygenated pitch powder was subjected to pyrolysis by placing it in an inert atmosphere of Argon gas and heated from room temperature (25° C.) up to 600° C. at rate of 1° C. per minute, it was observed that the oxygenated pitch powder of the present invention did not melt. In other words, the oxygenated pitch powder of the present invention was rendered infusible by heating in an inert atmosphere.

What is claimed is:

1. A process for infusing oxygen into pitch without stabilizing said pitch, said process comprising the steps of:

(a) heating said pitch in an oxygen-containing atmosphere at a heating temperature above 25° C. but less than the pitch critical temperature, said pitch critical temperature being the temperature at which oxidation of said pitch begins to occur; and (b) continuing said heating of said pitch while maintaining said heating temperature at a level less than said pitch critical temperature until an oxygenated, but unstabilized, form of said pitch is obtained.

2. The process of claim 1 further comprising the step of:

(c) heating said oxygenated pitch in an inert atmosphere to pyrolize said pitch.

3. The process of claim 1 further comprising the step of:

(c) heating said oxygenated pitch in an inert atmosphere at a temperature above said pitch critical temperature and lower than the melting temperature of said pitch to stabilize said oxygenated pitch.

4. The process of claim 1 further comprising the steps of:

(c) heating said pitch in an inert atmosphere at a temperature above said pitch critical temperature and above the melting temperature of said pitch to obtain a shapable pitch; and (d) shaping said shapable pitch into shaped pitch.

5. The process of claim 4 further comprising the step of:

(e) pyrolizing said shaped pitch by heating said shaped pitch in an inert atmosphere.

6. The process of claim 4 further comprising the step of:

(e) pyrolizing said shaped pitch by heating said shaped pitch in an oxygen-containing atmosphere.

7. The process of claim 1 further comprising the steps of:

(c) heating said oxygenated pitch at a temperature above said pitch critical temperature and above the melting temperature of said pitch.

8. The process of claim 7 wherein said oxygenated pitch is heated in an inert atmosphere.

9. The process of claim 7 wherein said oxygenated pitch is heated in a oxygen-containing atmosphere.

10. The process of claim 7 wherein said oxygenated pitch is shaped during said heating of said oxygenated pitch.

11. The process of claim 1 further comprising the step of:

(c) heating said oxygenated pitch in an oxygen-containing containing atmosphere at a temperature above 25° C. but less than the pitch critical temperature.

12. The process of claim 11 further comprising the step of pyrolizing said oxygenated pitch in an inert atmosphere.

13. The composition produced according to the process of claim 1.

14. A composition comprising:

unstabilized oxygenated pitch capable of being stabilized in an inert atmosphere.

15. The composition of claim 14 wherein the oxygen concentration of said oxygenated pitch is at least about 0.25 percent by weight.

16. The composition of claim 14 wherein the oxygen concentration of said oxygenated pitch is at least about 0.5. percent by weight.

17. The composition of claim 16 wherein the oxygen concentration of said oxygenated pitch is at least about 1.0 percent by weight.

18. The composition of claim 14 wherein the oxygen concentration of said oxygenated pitch is at least about 2.0 percent by weight.

19. The composition of claim 14 wherein the oxygen concentration of said oxygenated pitch is at least about 3.0 percent by weight.

20. The composition of claim 14 wherein the oxygen concentration of said oxygenated pitch is at least about 6.0 percent by weight.

* * * * *